United States Patent [19]

Casciano et al.

[11] 4,007,937

[45] Feb. 15, 1977

[54] TENNIS GAME BOARD

[76] Inventors: Robert M. Casciano; Donna R. Casciano, both of 214 Long Pond Road, Hewitt, N.J. 07421

[22] Filed: May 27, 1975

[21] Appl. No.: 581,429

[52] U.S. Cl. ..... 273/134 CA; 273/131 K; 273/131 C

[51] Int. Cl.[2] ..... A63F 3/00

[58] Field of Search ..... 273/85, 131, 134

[56] References Cited

UNITED STATES PATENTS

| | | | |
|---|---|---|---|
| 439,425 | 10/1890 | Presbrey | 273/85 R |
| 1,102,954 | 7/1914 | Ries et al. | 273/85 R |

FOREIGN PATENTS OR APPLICATIONS

| | | | |
|---|---|---|---|
| 922,097 | 1/1947 | France | 273/85 R |
| 790,150 | 9/1935 | France | 273/85 R |
| 504,541 | 4/1939 | United Kingdom | 273/134 CB |
| 541,929 | 12/1941 | United Kingdom | 273/131 C |
| 1,217,728 | 12/1970 | United Kingdom | 273/134 CA |

*Primary Examiner*—Delbert B. Lowe
*Attorney, Agent, or Firm*—Edward Goldberg

[57] ABSTRACT

A game board includes a tennis court with a net line across the center and boundary lines outlining the playing and serving areas. The court is divided into a grid with horizontal and vertical coordinates to indicate the particular locations of the ball and players. Various selective cards and tiles determine the serving, hitting and positioning of the ball and movement of the players to simulate an actual game of tennis. Player markers, a ball marker and scoring markers follow the positions on the court and the scores of the opponents.

7 Claims, 1 Drawing Figure

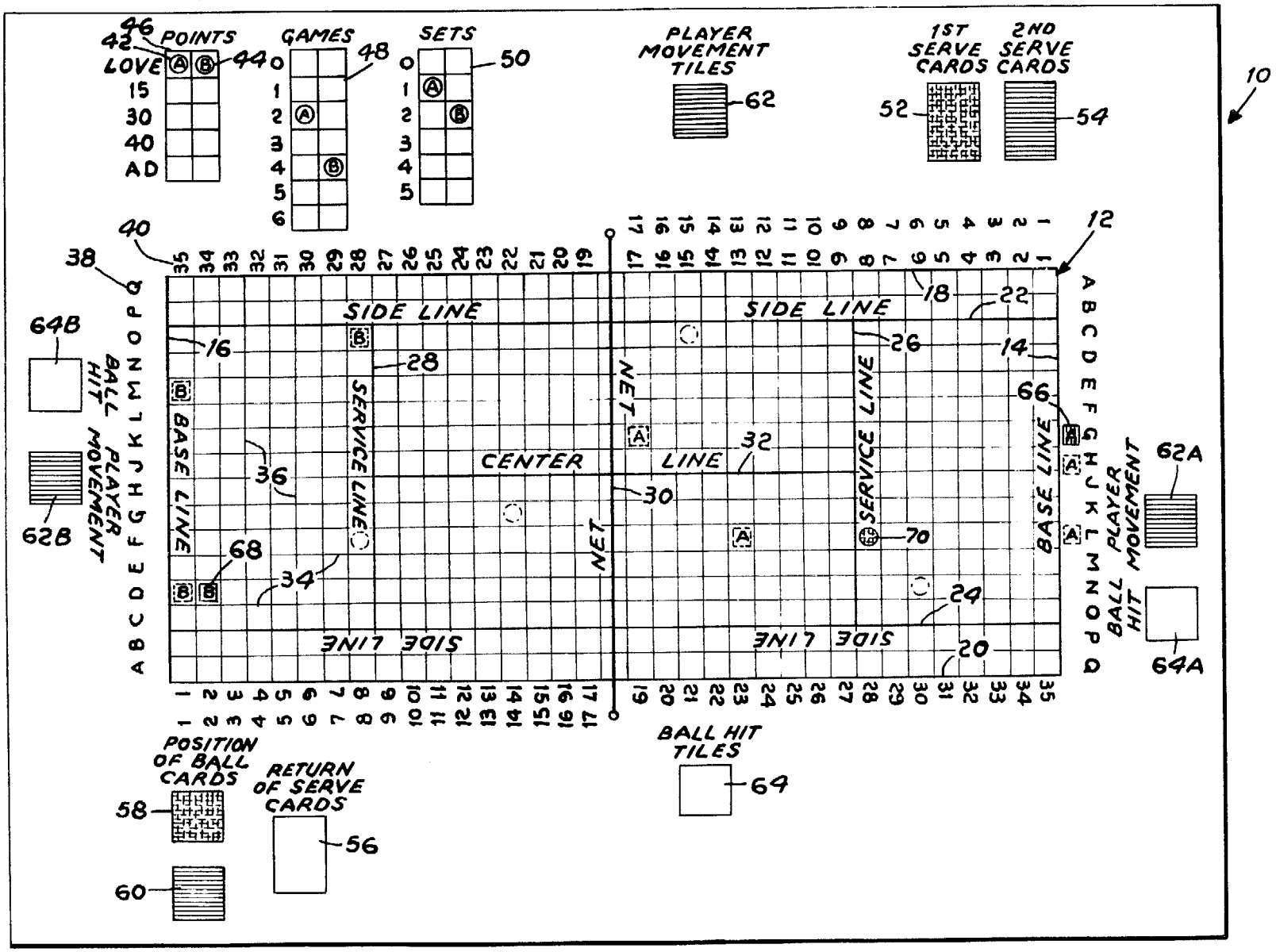
10
12
A B C D E F G H J K L M N O P Q
BASE LINE
SERVICE LINE
SIDE LINE
SIDE LINE
NET
NET
CENTER LINE
SIDE LINE
SIDE LINE
SERVICE LINE
BASE LINE
BALL HIT
PLAYER MOVEMENT
BALL HIT
PLAYER MOVEMENT
2ND SERVE CARDS
1ST SERVE CARDS
PLAYER MOVEMENT TILES
BALL HIT TILES
SETS
GAMES
POINTS
LOVE 15 30 40 AD
POSITION OF BALL CARDS
RETURN OF SERVE CARDS
14
16
18
20
22
24
26
28
30
32
34
36
38
40
42
44
46
48
50
52
54
56
58
60
62
62A
62B
64
64A
64B
66
68
70

TENNIS GAME BOARD

FIELD OF THE INVENTION

The present invention is directed to a novel tennis game board and particularly to a board which simulates an actual tennis game including a court, player and ball movements and scoring.

DESCRIPTION OF THE PRIOR ART

Previous tennis game boards have utilized implements such as small bats or paddles to strike objects such as discs to propel them over miniature nets. Some have also had square shaped areas or zones numbered to designate different scoring values determined by the landing position of the ball. Examples of such games are shown in U.S. Pat. Nos. 2,069,487, issued Feb. 2, 1937 and 2,500,683 issued Mar. 14, 1950.

SUMMARY OF THE INVENTION

It is the primary object of the present invention to provide a gam board which closely simulates an actual game of tennis with a court having standard boundaries, playing rules, movement of players, serving, hitting and returning balls and scoring.

This is achieved with a novel game board including a tennis court with outer boundaries, intermediate lines and net to define the playing and serving areas. The court is divided into a plurality of squares having lettered and numbered vertical and horizontal coordinates to locate the positions of the ball and players. The players select various cards and tiles which indicate service of the ball, return of the serve, position of the ball, ball hits, and player movement. A plurality of markers indicate the position of the players, ball and scores. Points are gained by respective players hitting the ball so that it cannot be returned by the opponent or by hitting the ball out of bounds, as in an actual tennis game. The details of play and other objects of the game will be more fully understood from the following description and accompanying drawing.

BRIEF DESCRIPTION OF THE DRAWING

The single FIGURE shows the game board with the court area, cards, tiles, and player, ball and scoring markers.

DESCRIPTION OF THE PREFERRED EMBODIMENT

The board, apparatus and rules of the game are made to conform as closely as possible to an actual game of tennis. This includes serving, returning and hitting the ball, player movements and number of players, for either singles or doubles, and scoring. The apparatus includes a playing board, five stacks of cards including First Serve, Second Serve, Return of Serve and two Position of Ball stacks, one each for lettered and numbered coordinates. There are also two sets of tiles for Ball Hit and Player Movement, four player markers, one ball marker, and six scoring markers. Different colors or shapes are used to distinguish various cards, tiles and markers which are made of any suitable materials. The tiles may be in the form of small cardboard or plastic cards.

The Court

As shown in the figure, the game board 10 is rectangular and includes thereon a representation of a rectangular tennis court area 12, proportioned similarly to a standard sized court, having opposite baselines 14, 16 across each end, outer side boundary lines 18, 20 along each side, inner sidelines 22, 24 spaced from each outer side, service lines 26, 28 at intermediate crossing positions between lines 22, 24 and parallel to and spaced from each end, a net 30 across the center of the court, and a center line 32 lengthwise between the two service lines. The court is divided into a grid of horizontal and vertical lines 34, 36 forming a plurality of squares, or incremental rectangular areas, designated by lettered and numbered coordinates 38, 40. There are 35 squares, 1–35 along the outer sidelines 18, 20 or the length of the court, with the net being across row 18. There are also 16 squares A–Q, with letter I being omitted, across the width along the baselines 14, 16. The full width A–Q is used for a game of doubles, while only 12 squares, C–O between sidelines 22, 24, are used for a singles game. The numbers 19–35 are used to facilitate locating the positions on the opposite sides of the court.

The players serve from behind the baselines 14, 16 on one side of the centerline 32 to hit the ball over the net 30 into the diagonally opposite service area. The service areas are bounded by the sidelines at C and O, and service lines, 26, 28, along the court on each side of the net. Looking from one end, the area from lines 28–35 on the far side of the net between the sevice line and base line, is called the back court, while the area close to the net is called the fore court. After the serve, all returned balls must land over the net between the sidelines C–O and the base line for a singles game, and between the outer side boundaries A–Q for a doubles game.

Scoring

Scoring is done in the same manner as in an actual game of tennis. As indicated in the Points box 46, points are scored as follows: zero points is Love, one point is 15, two points are 30, three points are 40, and four points are game. Winning a game must be by a margin of two points. If, for example, the opponents both have scores of 40, the next point does not win. A 40—40 tie score is called a Deuce, after which a player must get two more consecutive points in order to win the game. The player getting the first point after Deuce has the Advantage. If the same player scores a second point, he wins the game. If the other player gets the second point, the score goes back to Deuce.

At the start of the game, the different colored scoring markers 42, 44 of the two players A and B, or two teams, are both placed at Love or zero Points position in box 46, zero Games position in box 48, and zero Sets in box 50. For each point, the markers are moved down successively to 15, 30, 40 and Ad, or game positions. If there is a margin of two points, the game is won and the Game marker for that player is moved from 0 to 1, while the Points marker is returned to Love. The roles of server and receiver are reversed after each game so that each player takes a turn at the two positions. After six games are won, also by a margin of two, the player wins a set and the Set marker is moved to 1, while the Game marker is returned to 0. The players may decide whether they wish to play to win with two out of three sets or three out of five sets.

Setting Up the Playing Board

Before starting the game, the players flip a coin to determine the server and receiver. All of the stacks of cards and tiles are mixed and placed face down on the board, as indicated. The 1st and 2nd Serve cards 52, 54, colored yellow and blue, respectively, are placed at one side in front of the server, and the Return of Serve card stack 56, white, and Position of Ball cards 58, 60, yellow and blue, for the return of serve, are placed at the other side in front of the receiver. Player Movement tiles 62, red, and Ball Hit tiles 64, white, are placed face down in two piles at opposite sides of the board. Six scoring markers 42, 44, red and white, are positioned, two each, at Love points. 0 Games, and 0 Sets. Each player, A and B, picks five Player Movement tiles 62A, 62B, and five Ball Hit tiles 64A, 64B, which are kept in front of each and replaced from the stacks 62, 64 are they are used during the game after each player's turn. At the end of the game, any number of tiles may be exchanged. Player markers 66, 68, red and white (or blue and green), are selected and placed at each end of the court in accordance with the selection as server or receiver. In this case, player A is the server, positioning marker 66 close to the center line 32 behind base line 14, at box G. Player B, as receiver, chooses to position his marker 68 at position D2. The position of ball marker 70, yellow, is determined during the play.

The Serve

Service of the ball is determined by selection from two stacks of cards 52, 54, designated 1st Serve and 2nd Serve cards. For example, in this case, there are 21 1st Serve cards, colored yellow, including 5 with the designation Fault, 1 Let, 13 In, and 2 Ace cards. The 2nd Serve cards number 34 and are blue. These have like designations including 3 Fault, 1 Let, 29 In, and 1 Ace. The distributions are chosen in accordance with professional playing statistics and can be changed to provide different conditions. Ace represents a serve that cannot be returned and the server wins a point. Let is a net ball and the server draws another 1st Serve card. The used cards are placed at the bottom of the stack. A Fault represents an out of bounds ball and the player then selects a card from the 2nd Serve stack. An In card represents a good serve, after which the server waits for a return ball from the receiver. When player A draws a second Serve card after a Fault, the cards have the same designations as the 1st Serve stack including Fault, Let, In and Ace. An Ace again results in a point score for the server, a Let results in another drawn card, and an In represents a good serve to the receiver. However, if the server draws another Fault card from the 2nd Serve stack, this results in a point for the receiver. Positioning of the server player marker at G, H, J or K behind the baseline is most effective, since this minimizes the number of spaces required to move to reach any return of serve that is In. The receiver also preferably positions his player marker at a location in the back court near the baseline and sideline behind the service area to which the serve is directed, for best results.

Return of Serve

When the server draws an In card, which are the majority of both the 1st and 2nd Serve cards, the ball is in play and the receiver must return it. The receiver then draws a card from the Return of Serve card stack 56 (white). This deck includes 26 cards including 6 Out, 4 Winner, and 16 In. A Winner card represents a good hit by the receiver which cannot be returned by the server and results in a point scored by the receiver. An Out card represents a ball which is not hit over the net within the playing area on the opposite side of the court and the server wins a point. An In card represents a good return by the receiver, after which the receiver draws one yellow and one blue card from the Position of Ball card stacks 58, 60. These cards are designated by number and letter to represent the particular square on the opposite side of the court to which the ball is hit. The yellow cards are numbered from 1–17, while there are 16 blue cards lettered A–Q, with I being omitted. The yellow ball marker 70 is placed on the selected location.

Player Movement

In order for the opponent to return the ball, he must reach the square that the ball is on or be in the path of the ball hit by the other player, whether the ball is hit straight or cross court. Player movement is determined by the Player Movement tiles 62, of which each had selected five at the start of the game. There are 68 tiles designating various movements by numbers of squares or to particular locations. These include 20- "1" tiles, 16- "2", 12- "3", 5 Net, 5 Sideline, 5 Baseline and 5 Service Line tiles. The five selected tiles may be used in any combination and the players may move in any direction. The tiles may be used to reach the ball location, as well as to move to a better position after the ball is hit, for returning the next ball. The numbered tiles allow the player to move that number of squares in any direction, while the location tiles permit movement diagonally or straight to the particular line or squares indicated. For the Sideline tile, the player may move to either Sideline. For the Service Line tile, movement is either forward or backward. The player may intercept and hit the ball if the paths cross, but must then stop on that square. Movement ends at the square before the designated line except when the ball is intercepted. Limiting the number of tiles used on any one play permits simulation of real situations. Conditions can be varied by allotting more tiles for expert play, which would permit more hits, while beginner play would have fewer tiles for fewer chances of hitting the ball. Use of more or fewer Player Movement tiles would also cause points to be obtained more slowly or rapidly.

Hitting the Ball

The Ball Hit tiles 64, colored white, indicate the type of hit and the number of squares or row to which the ball is hit. There are 57 Ball Hit tiles including 11 Cross Court (cc 2-cc 12), 34 Straight (S 2- S 35), 6 Drop Shot (2 each for lines 21, 22 and 23) and 6 Lob (2 each, for lines 33, 34 and 35). For the Cross Court hits, the ball is hit diagonally for the number of squares indicated. Straight shots are hit parallel to the sidelines for the number indicated. Lobs are hit to the player's choice of any square in the rows indicated, and Drop Shots are also hit to the choice of any square in the particular row. For example, Lob 35 permits placement of the ball on any square in row 35. Only one Ball Hit tile is used per turn and is replaced, while all five Player Movement tiles may be used and replaced. For example, the player may combine three movement tiles to reach the ball, one hit tile to get the ball over the net and two movement tiles to reposition himself. Additional tiles are then drawn to replace those used. If the tiles are not sufficient to get the ball over the net or to reach the ball, the opponent gains a point.

Play of the Game

The following typical examples will illustrate the play of the game. Player A, marker 66, is the server and starts with Player Movement tiles 3, 3, 1, 2 and Service Line, and Ball Hit tiles cc 7, cc 12, S 20, S 31 and Lob 35. Player B, 68, is the receiver and has Player Movement tiles - Sideline, Baseline, 3, 3 and 1 and Ball Hit tiles - Drop Shot 21, S 4, S 29, cc 3 and cc 9. Player A positions his player marker at G behind the baseline and Player B positions his marker at D 2. Player A picks a 1st Serve Card which is IN. Player B picks a Return of Serve Card which is In and Position of Ball cards L and 8 and places the ball marker 70 at L-8 on A's side of the court. Player A uses Player Movement tile - Service Line to move forward and 1 and 3 to move sideways to reach the ball at L-8. He then uses Ball Hit tile S 20 to hit the ball 20 squares straight to square F 8. He then uses Player Movement tiles 3 and 2 to move forward to square L 13. Player A picks five new Player Movement tiles: Net, Net, 1, 2 and 3, returns the Ball Hit tile S 20 to the stack and picks another tile cc 2. Player B uses Player Movement tiles 3, 3, combining forward and diagonal movements to reach the ball at F 8, and Ball Hit tile - Drop Shot 21, to hit the ball to square C 15 (the choice of square in line 21). He then uses Player movement tile, Sideline, to move his marker sideways to square O 8, and picks new Player movement tiles 3, 2, and Baseline, and Ball Hit tile cc 6. Player A gets to the ball by using a Net tile to move diagonally to square G 17, and tiles 1 and 3 to combine sideways and diagonal movements to get to square C 15. He then uses Ball Hit tile cc 7 to hit the ball to square G 14. Player B cannot get to the ball and loses the point. The score is now 15-Love Player A draws three Player Movement tiles, one Ball Hit tile and positions his marker at K behind the baseline. Player B positions his marker at M 1. Player A now has Player Movement tiles: Net, Baseline, Sideline, 1 and 2, and Ball Hit tiles: S 20, S 31, cc 2, cc 12 and Lob 35. Player B has Player Movement tiles: Baseline, Baseline, 3, 1 and 2, and Ball Hit tiles: S 4, S 29, cc 3, cc 6 and cc 9. Player A picks a 1st Serve card - Fault He then picks a 2nd Serve Card- In. Player B picks a Return of Serve card- Winner. The scores is now 15—15.

Player A positions his player marker at H behind the baseline and Player B is at D 1. A picks a 1st Serve Card-In, uses Player Movement tile-Net to get to square H 17 and picks a Player Movement tile- Baseline. Player B picks Return of Serve card- In and Position of Ball cards N and 6, and places the ball marker on square N 6. Player A cannot get to the ball and loses the point. The score is now 15–30.

Player A picks a 1st Serve Card which is Ace. The score is now 30—30. Player A picks a 1st Serve Card-In. Player B picks a Return of Serve card- Out. The score is now 40–30. Player A picks a 1st Serve Card-Fault, and a 2nd Serve Card- Fault. The score is now tied at Deuce. This procedure then continues until the end of the game which must be won by two points.

Additional rules and variations may include that the players can intercept all shots passing within one square of their position when in the fore court. A straight or cross court shot hit past a player who is in the fore court is a winner, and a drop shot hit from within the fore court when the opponent is in the back court is a winner. A player may also hit from a position one space from the ball. For doubles play, each player may use three Player Movement tiles and three Ball Hit tiles. Either player on a side may move to the ball and hit. All other rules would remain the same for both doubles and singles.

It may thus be seen that the present invention provides a novel board game which closely simulates an actual game of tennis. While several embodiments have been illustrated and described, it is apparent that many variations may be made in the particular form and procedure without departing from the scope of the invention as set forth in the appended claims.

What is claimed is:

1. A tennis game board comprising:

a rectangular tennis court area, a net line across the center of said court area dividing said court into opposite sides, a plurality of longitudinal and lateral boundary lines dividing said court area into playing and serving areas, a plurality of equally spaced longitudinal and lateral grid lines dividing said court area into a plurality of like incremental rectangular areas, coordinate markings along said grid lines to indicate successive individual incremental areas of said court, a plurality of player markers to indicate the position of individual players with respect to the court area, a ball marker to indicate the position of the ball on the court area, a plurality of stacks of cards having indicia thereon selectively designating types of service and return of service of the ball by the players, a stack of ball position cards having indicia thereon selectively directing movements of the returned served ball to designated incremental rectangular area positions on the court, a stack of player movement tiles having indicia thereon selectively directing player movements to designated area positions on the court with respect to the position of the ball, a stack of ball hit tiles selectively directing further ball movements to succeeding designated area positions on said court during continuing play following said movements of the returned served ball, a plurality of scoring markers, and means for indicating the scores of different players.

2. The game board of claim 1 wherein said boundary lines include a pair of baselines across opposite ends of said court, a pair of intermediate service lines positioned between said opposite baselines and said netline dividing each side of said court into fore and back court areas, a longitudinal centerline extending between said service lines, and a pair of intermediate sidelines parallel to and spaced from said centerline and from the outer longitudinal boundaries.

3. The game board of claim 2 wherein said coordinate markings include successively numbered incremental areas along the sides of said court and lettered incremental areas across the ends of said court.

4. The game board of claim 3 wherein said stacks of cards indicating types of service and return of service of the ball include a stack of first serve cards, a stack of second serve cards and a stack of return of serve cards.

5. The game board of claim 4 wherein said ball position cards directing the , returned served ball include a first stack of cards indicating a lettered incremental area and a second stack of cards indicating a numbered incremental area.

6. The game board of claim 5 wherein said means for indicating the scores includes three rectangular boxes respectively displaying points, games and sets, each box including two columns for receiving two scoring markers, and a plurality of lines dividing said columns into successive scoring areas.

7. The game board of claim 5 wherein one side of said court is selected as the server's side and the other side as the receiver's side, stacks of said first and seconds serve cards being disposed on the server's side, said second serve cards providing said server with a second chance to serve the ball after a fault or let first serve card, said return of serve cards and ball position cards being disposed on the receiver's side, said ball position cards being associated with said return of serve cards to represent the positions of the ball of an in return of serve by the receiver, selective groups of said ball hit tiles and player movement tiles from respective stacks of tiles being positioned on both sides of said court for selectively directing movements of each player in turn to reach the ball position and to hit the ball to a new position, said player and ball markers being successively positioned on the respective incremental court areas indicated by the player movement and ball hit tiles to simulate an actual game of tennis.

* * * * *